United States Patent [19]

Peleg

[11] Patent Number: 4,837,990

[45] Date of Patent: Jun. 13, 1989

[54] SHELTERING STRUCTURES AND A METHOD OF ASSEMBLING SAME

[76] Inventor: Alexander Peleg, Moshav Betzaron, Near Gadera, Israel

[21] Appl. No.: 67,417

[22] Filed: Jun. 22, 1987

[30] Foreign Application Priority Data

Jun. 24, 1986 [IL] Israel ..... 79203

[51] Int. Cl.[4] ..... E04B 1/12

[52] U.S. Cl. ..... 52/63; 52/86; 47/17; 47/29; 135/97

[58] Field of Search ..... 52/63, 18, 2; 135/97, 135/102; 47/17, 29, 26

[56] References Cited

U.S. PATENT DOCUMENTS

| | | | |
|---|---|---|---|
| 2,910,994 | 11/1959 | Joy | 52/2 |
| 2,996,729 | 8/1961 | Bailey | 52/63 |
| 3,765,134 | 10/1973 | Gilchrist | 52/63 |
| 3,925,942 | 12/1975 | Hemmelsbach | 135/97 |
| 4,117,636 | 10/1978 | Smith | 52/63 |
| 4,258,514 | 3/1981 | St. Clair | 52/157 |
| 4,313,279 | 2/1982 | Greenbaum | 47/29 |

FOREIGN PATENT DOCUMENTS

| | | | |
|---|---|---|---|
| 655445 | 12/1928 | France | 52/2 P |
| 1479336 | 5/1967 | France | 47/29 |
| 1416993 | 2/1973 | United Kingdom | 47/29 |
| 1447043 | 8/1976 | United Kingdom | 135/102 |
| 1498945 | 1/1978 | United Kingdom | 52/63 |

*Primary Examiner*—Henry E. Raduazo

*Attorney, Agent, or Firm*—Browdy & Neimark

[57] ABSTRACT

The invention provides a sheltering structure essentially constructed of a framework and a cover of sheet material. The structure includes a plurality of arched bars arranged in a plurality of rows, wherein at least most of the bars are supported at their end portions at least indirectly by the ground, wire or rod-like elements extending between at least some of the arched bars disposed along a row, strips of sheet material, each strip extending in the direction of the planes of, and supported by, the arched bars and the elements, and means for securing the strips above the bars, the means extending across the strips along troughs formed between adjoining rows of arched bars. A method of assembling a sheltering structure is also described.

17 Claims, 5 Drawing Sheets

SHELTERING STRUCTURES AND A METHOD OF ASSEMBLING SAME

The present invention relates to sheltering structures essentially constructed of a framework and a covering of sheet material. The invention also relates to a method of assembling a sheltering structure.

Structures of this kind are generally, but not necessarily, made of a metal framework assembled from interconnectable elements and of sheet material, such as, textile fabric or plastic film. Among various possible uses of this type of structure, a most suitable use is for greenhouses, wherein the sheet material is a transparent, semi-transparent or opaque plastic covering.

It is an object of the present invention to provide a sheltering structure of relatively low weight and cost per unit covering area and to provide a structure which is easy to erect.

It is a further object of the invention to provide a sheltering structure having versatile ventilation capabilities, operatable and controlled from a minimal number of locations.

It is a particular object of the present invention to provide a structure enclosing two or more juxtaposed tunnel-like spaces so that substantially the entire area enclosed by the structure can be utilized and to avoid the common use of a multiplicity of diagonally disposed supporting and anchoring struts and cables which are usually attached at least to the outside walls of such structures thereby occupying utilizable ground and constituting obstacles to cultivating implements.

In accordance with the present invention, a sheltering structure is essentially constructed of four different framework and sheet material components, each component having a longitudinal axis, these components comprising (a) a plurality of arched bars arranged in a plurality of rows, forming adjoining columns, wherein at least most of the bars are supported at their end portions at least indirectly by the ground;

(b) wire or rod-like elements extending between and connected to at least some of the arched bars disposed along a column;

(c) strips of sheet material, (i) each strip extending along and being supported by the arched bars, (ii) each strip extending across and being supported by the wire or rod-like elements, an (iii) adjacent strips partly overlapping one another, and (d) securing means for securing the strips above the bars, the securing means extending across the strips along troughs formed between the adjoining columns of arched bars, thereby forming a structure of four superposed different components, wherein the longitudinal axis of each of the components (a) to (d) traverses the longitudinal axis of one of the different components immediately adjacent thereto.

A sheltering structure according to the present invention may also be essentially constructed of a framework and a cover of sheet material comprising a plurality of semi-circularly curved bars forming arches and arranged in a plurality of rows extending in a first direction, these arched bars forming a plurality of adjoining columns extending in a second direction disposed at approximately 90° to the rows, and wherein at least most of the bars are supported at end portions at least indirectly by the ground; wire or rod-like elements extending in the second direction between at least some of the arched bars disposed along a column; strips of sheet material, each strip extending in the first direction approximately 90° from and across said columns and along the lengths of the arched bars, these strips of sheet material having overlapping edges and being supported by the arched bars and the wire or rod-like elements so as to provide tensioning of the framework in the direction of the rows; and securing means for securing the strips above the bars, such securing means extending in the second direction across the strips along troughs formed between the adjoining columns of arched bars.

The invention further provides a method of assembling a sheltering structure essentially constructed of a framework and a cover of sheet material comprising the steps of:

erecting a plurality of arched bars, arranged in a plurality of rows, the end portions of said bars being at least indirectly supported by the ground;

extending wire or rod-like elements between at least some of said arched bars disposed along a row;

spreading strips of sheet material in the direction of the planes of, and supported by, said arched bars and said elements, and placing means for securing said strips above said bars along troughs formed between rows of arched bars.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
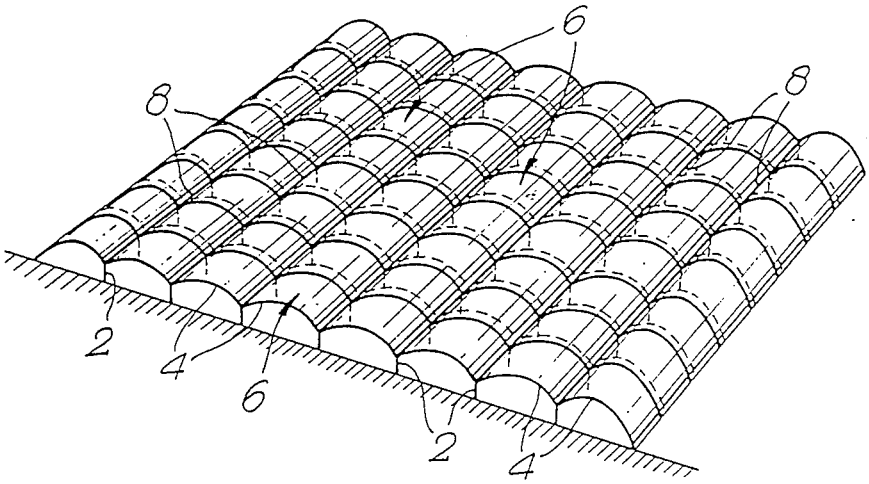
FIG. 1 is a schematic view of a sheltering structure according to the present invention.
Figure 5:
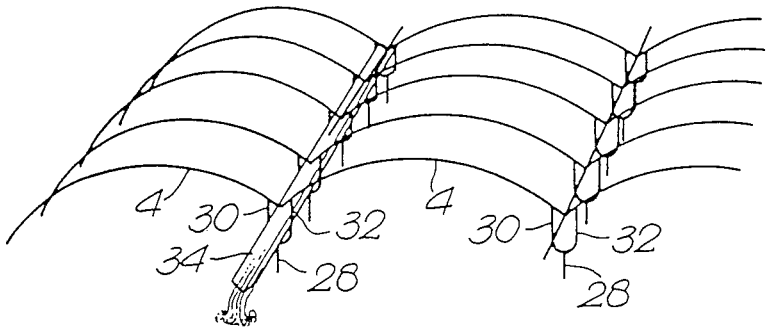
FIG. 5 is a schematic view of a modified sheltering structure according to the invention.
Figure 7:
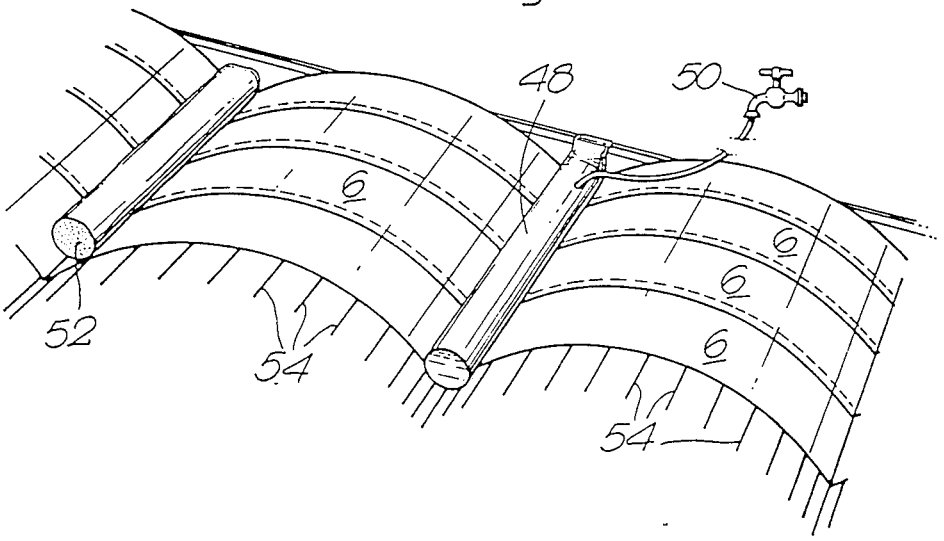
FIG. 7 is an isometric view of still further means, according to the invention, for affixing the strips to the bars.

There is seen in FIG. 1 a schematic view of the sheltering structure, according to the invention, comprising a plurality of poles 2 arranged in rows and columns (in the figure only the front poles are seen), and a plurality of pairs of coplanar arched bars 4 connected to the top portion of the poles at both ends of both of the bars constituting such a pair, except for the bars at the lateral sides of the structure, wherein one end of a bar is connectable to the ground. The arched bars are covered with strips 6 of sheet material, e.g., plastic film preferably in a partly overlapping fashion. The strips 6 extend from the bottom of a lateral side of the structure in the direction of the plane of the bars to the bottom of the other lateral side of the structure, as opposed to the usual covering of similar structures which extend in the direction of the channel-like roof, from front to back; this provides tensioning of the structure from side to side as best shown in FIGS. 1, 5 and 7. The structure further comprises means 8 for affixing and securing the strips 6 above the arched bars 4, which means 8 may be embodied in various ways described hereinafter, however, which means are generally characterised by their disposition which is across the strips 6 and along the top portions of the poles 2.

Figure 2:
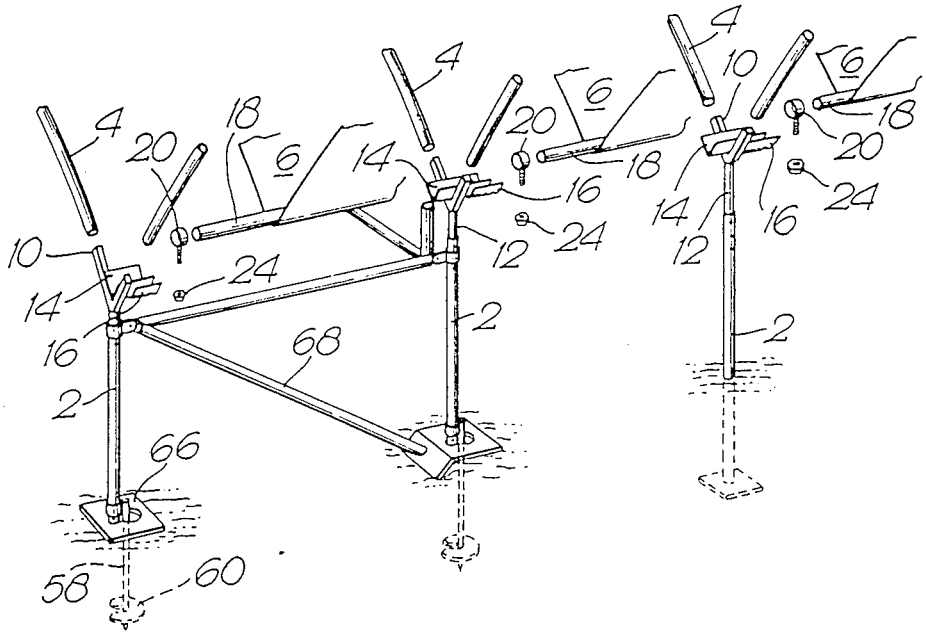
FIG. 2 is an exploded view of some of the structure's elements showing the manner in which they are assembled.
Figure 3:
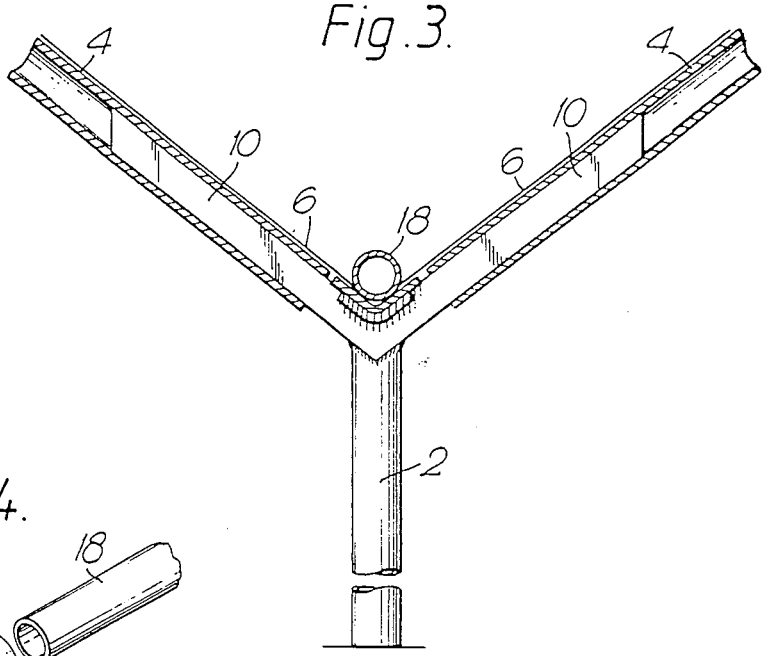
FIG. 3 is a cross-sectional view of a pole and elements for affixing thereon the bars and the covering strips.
Figure 4:
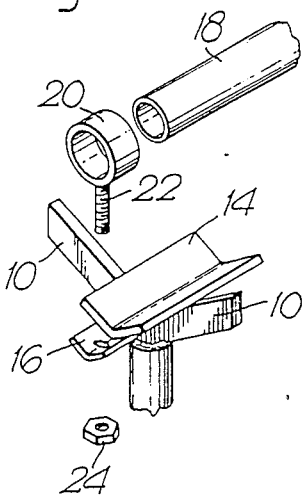
FIG. 4 is an exploded view of a first embodiment of means for affixing the strips to the poles.

Referring to FIGS. 2, 3 and 4, there are seen the arched bars 4 conveniently made of tubular sections, wherein end portions of the bars 4 are adapted to be slipped over stubs 10, angularly and upwardly extending from the top portion of each pole 2. In order to facilitate the levelling of the roof or covering of the structure when erected on an uneven terrain, two stubs 10 may be interconnected with a leg portion 12 to form a Y-shaped element, telescopically adjustably mounted on the top of each pole 2. As further seen in the figures, conveniently, trough-like members 14 are horizontally affixed on top of the poles 2 and each of said members has a connecting element 16 extending therefrom, to which element there is affixed a tube 18, e.g., a metal pipe, by means of a collar 20 having a bolt 22 and by means of a nut 24. In this manner the partly overlapping strips 6 are stretched over the arched bars 4 and are held down over the arches so as to form a complete covering. The disadvantage of this arrangement for affixing the strips is, however, that at each affixing location the strip 6 is pierced by the bolt 22 and thus there exists a possibility that the covering will not be water tight and will leak. In order to prevent such leakage, the structure may be slightly modified (see FIG. 5) by the provision of poles 28 having two spaced-apart arms 30 and 32 at their top portions. The bars 4 are affixed to the top portions of the arms 30 and 32 and through the spaces existing in between the arms there is disposed a water draining channel 34. These channels, which may be made of bent plastic strips configured and slantingly hung in place by means of wires, will collect any water drops leaking through the roof and direct the water to the desired place.

Figure 6:
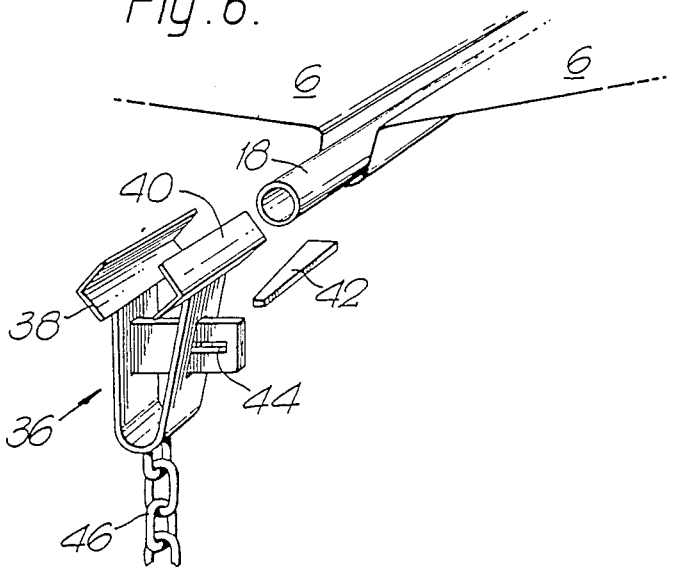
FIG. 6 is an exploded view of a second embodiment of means for affixing the strips to the poles.

The plastic strips 6 may be differently attached to the poles 2 so as to avoid the piercing of the strips altogether. As shown in FIG. 6, a tube 18 is placed across the strips 6 and the thusly covered tube 18 can be tightly held by means of a clamp 36 having jaws 38 and 40 preferrably lined with soft pads (not shown), and having a wedge 42 slidingly fitting a slot 44 of the clamp for effecting the clamping action. The clamp 36 can be attached to the top portion of a pole 2 by means of a tensioning chain 46 or by any other means for adjusting the tension.

In still a further arrangement illustrated in FIG. 7, instead of securing the strips 6 in the troughs formed between adjoining arched bars by means of tubes 18, the strips 6 may be conveniently held in place to form a roof by means of longitudinally extending sleeves 48 filled, in situ, with water from a water source 50. Alternatively, such a sleeve may be filled with any other pourable material such as sand, to form a sand filled longitudinally extending sleeve 52. Notwithstanding the manner of attaching the strips 6 to the poles, in order to avoid sagging of the strips 6, the arched bars 4 may be interconnected with rod-like elements or wires 54 which wires will support the strips 6 stretched thereacross as also seen in the figure.

Figure 8:
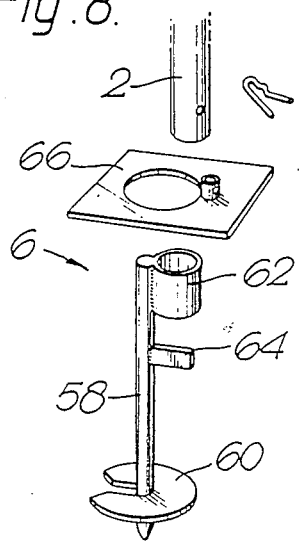
FIG. 8 is an exploded view of an anchoring assembly for anchoring the poles and bars to the ground.

Referring again to FIG. 2, in conjunction with FIG. 8, there is seen an anchoring assembly 56 especially suitable for anchoring the poles 2 and 28 (FIG. 5), as well as the end portions of the bars 4 directly to the ground. The assembly 56 comprises a pointed rod 58 having at the lower portion a drilling disc 60 for cutting into the ground and at the upper portion a collar 62 sized and configured to slip over the bottom portion of a pole 2 or bar 4 and an abutment 64 forming a solid base for the edge of a pole or bar. Optionally, the assembly may also be provided with an aperture plate 66 adapted to lean against the abutment 64 and serving as a weight distributor for a pole and its load especially when placed on soft ground.

Figure 9:
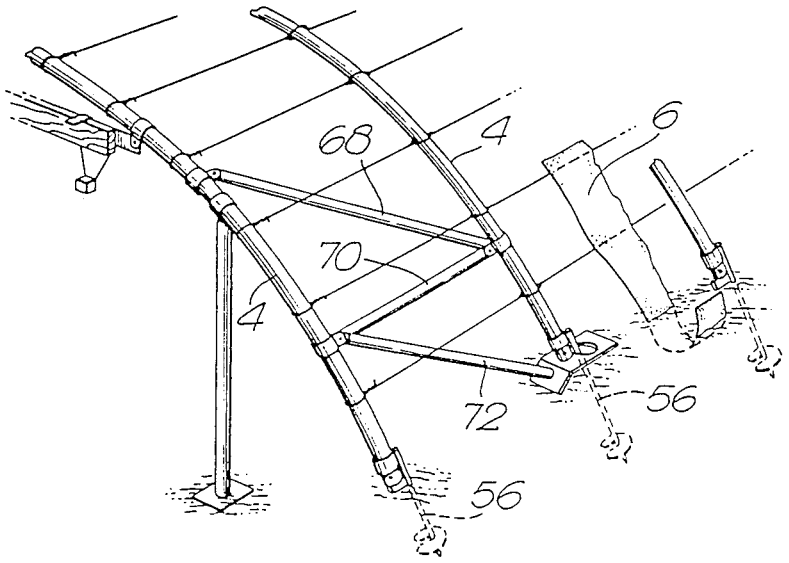
FIG. 9 is an isometric view of a part of a sheltering structure showing several constructional details.

The structure may further be rigidified by interconnecting the poles and/or the bars by means of struts 68, ties 70 and braces 72 and the lateral edges of the strips 6 may be buried in the ground adjacent to the anchoring assemblies 56 as seen in FIG. 9. The front and rear openings of the tunnel-like structure may be completed with openable curtains, for ventilation purposes.

Figure 10:
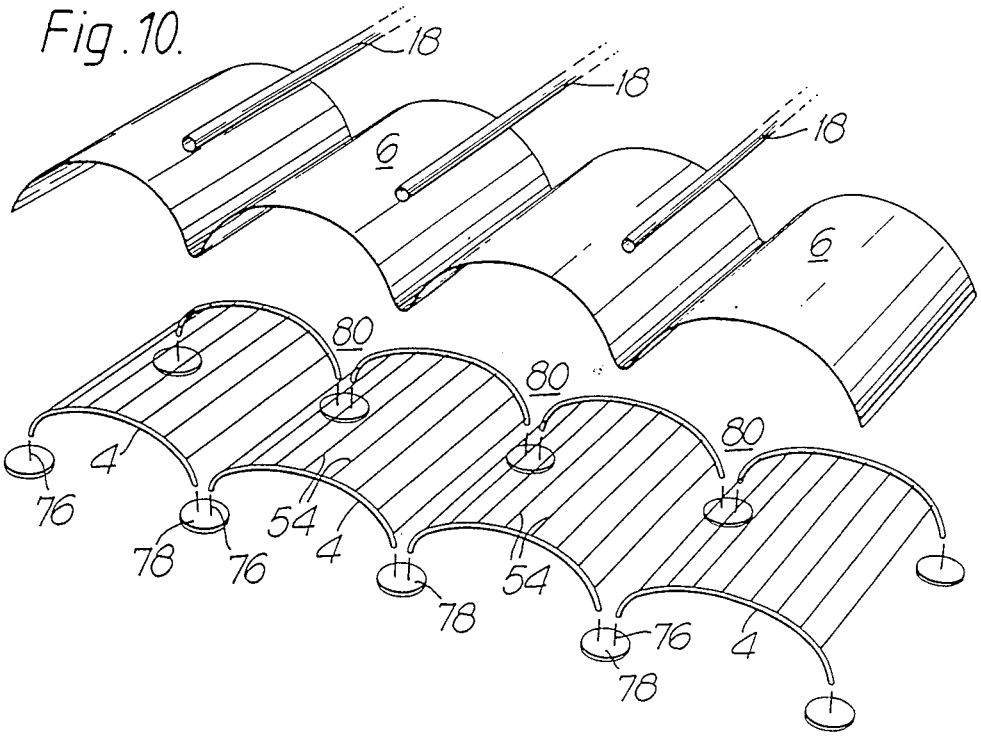
FIG. 10 is a schematic exploded view of some of the structure's elements showing a further embodiment of arched bars support.

A further possible modification is illustrated in FIG. 10. Accordingly, the arched bars 4 are affixed at their end portions to stubs 76, which stubs may conveniently project from base elements 78 placed on the ground or buried thereunder. When the bars 4 are made of pipes or tubes, the stubs may be in the form of a rod, the diameter of which is chosen to fit in the hollow of the tube. Naturally, securing means in the form of throughgoing pins or the like for removably securing the bars onto the stubs, may also be provided.

Also seen in the figure are the rod-like elements 54, interconnecting the arched bars 4, the strips of sheet material 6 extending across the direction in which the rod-like elements 54 extend, and the tubes 18 which are placed across the strips of sheet material 6 along the troughs 80 formed between adjoining rows of the arched bars.

Figure 11:
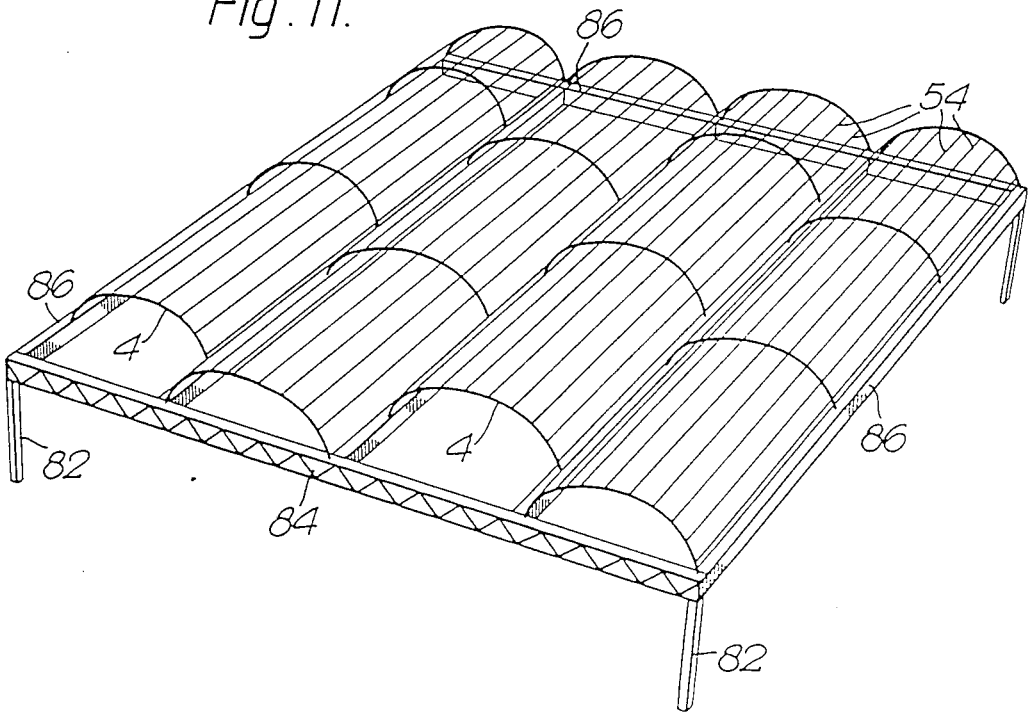
FIG. 11 is a schematic view of still a further embodiment of a structure according to the present invention.

The sheltering structure according to the present invention is also applicable for covering spans delimited by an existing skeleton structure. Such a skeleton structure and the sheltering structure of the present invention is illustrated in FIG. 11. Seen are the frontal support columns 82, the beam 84 and the purlins 86 extending from the frontal beams 84 to the rear beam (not shown). In this embodiment the arched bars 4 in adjacent rows are not necessarily coplanar and are affixed onto the skeleton structure by any means devised by a skilled man.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A sheltering structure essentially constructed of four different framework and sheet material components, each component having a longitudinal axis, said components comprising:

(a) a plurality of arched bars arranged in a plurality of rows, forming adjoining columns, wherein at least most of said bars are supported at their end portions at least indirectly by the ground;

(b) wire or rod-like elements extending between, and connected to, at least some of said arched bars disposed along a column;

(c) strips of sheet material, wherein (i) each strip extends along and is supported by, said arched bars, (ii) each strip extends across and is supported by, said elements, and (iii) adjacent strips are partly overlapping, and (d) securing means for securing said strips above said bars, said securing means extending across said strips along troughs formed between said adjoining columns of arched bars, whereby there is formed a structure of four superposed different components, wherein the longitudinal axis of each of said components (a) to (d) transverses the longitudinal axis of one of said different components immediately adjacent thereto.

2. The structure as claimed in claim 1 wherein arched bars of adjoining rows are coplanar.

3. The structure as claimed in claim 1 wherein said end portions are supported on the ground by means of poles.

4. The structure as claimed in claim 1 wherein said end portions are supported on the ground by means of stubs projecting from the ground.

5. The structure as claimed in claim 1 wherein said end portions are affixed to beams and purlins of a skeleton structure.

6. The structure as claimed in claim 1 wherein said bars are tubular.

7. The structure as claimed in claim 3 wherein a top portion of each of said poles is provided with two upwardly divergingly extending stubs for interconnection with ends of said arched bars.

8. The structure as claimed in claim 3 wherein the top portions of said poles are provided with troughlike members extending in the direction of said row of poles.

9. The structure as claimed in claim 8 wherein said stubs and said member are a single unit adjustably affixable onto the top portions of said poles.

10. The structure as claimed in claim 1 wherein said strips of sheet material are partly overlapping.

11. The structure as claimed in claim 3 wherein said strips are secured to the top portions of said poles by means of rods affixable to the top portions of said poles.

12. The structure as claimed in claim 1 wherein said strips are secured to the top portion of said poles by means of sleeves filled with pourable matter.

13. The structure as claimed in claim 11 wherein said strips are secured to the top portion of said poles by means of clamps releasably tightly holding together portions of said strips and said rods.

14. The structure as claimed in claim 1 wherein said strips of sheet material have long and short edges and wherein at least one of the short edges of said strips is affixed to the ground.

15. The structure as claimed in claim 3 further comprising a unit for anchoring said poles to the ground, said unit including a first portion having a drilling disc for cutting into the ground and a second portion for supporting and removably mounting the bottom portion of said pole.

16. The structure as claimed in claim 1 wherein said poles are provided at their top portions with upwardly extending arms, said arched bars being connected to said arms and further providing a water-draining channel disposed in between and extending along a row of said arms.

17. A sheltering structure essentially constructed of a framework and a cover of sheet material, comprising:

a plurality of semi-circularly curved bars forming arches and arranged in a plurality of rows extending in a first direction, said arched bars forming a plurality of adjoining columns extending in a second direction disposed at approximately 90° to said rows, wherein at least most of said bars are supported at end portions at least indirectly by the ground;

wire or rod-like elements extending in said second direction between at least some of said arched bars disposed along a column;

strips of sheet material, each strip extending in said first direction approximately 90° from and across said columns and along the lengths of said arched bars, said strips of sheet material having overlapping edges and being supported by said arched bars and said wire or rod-like elements so as to provide tensioning of said framework in the direction of said rows; and securing means for securing said strips above said bars, said securing means extending in said second direction across said strips along troughs formed between said adjoining columns of arched bars.

* * * * *